US007258127B1

(12) United States Patent
Schneider

(10) Patent No.: US 7,258,127 B1
(45) Date of Patent: Aug. 21, 2007

(54) PRESSURE DIVERTER VALVE AND SYSTEM

(76) Inventor: Daniel E. Schneider, 1302 Decker Dr., Worland, WY (US) 82401-9772

( * ) Notice: Subject to any disclaimer, the term of this patent is extended or adjusted under 35 U.S.C. 154(b) by 0 days.

(21) Appl. No.: 10/387,295

(22) Filed: Mar. 12, 2003

Related U.S. Application Data

(60) Provisional application No. 60/413,173, filed on Sep. 24, 2002.

(51) Int. Cl.
*F17C 13/04* (2006.01)

(52) U.S. Cl. ..... 137/12.5; 137/68.19; 137/109; 137/266; 141/351

(58) Field of Classification Search ..... 137/12.5, 137/109, 68.19, 266, 571, 625.48; 62/50.2; 141/351, 352
See application file for complete search history.

(56) References Cited

U.S. PATENT DOCUMENTS

| | | | | |
|---|---|---|---|---|
| 1,062,343 | A | | 5/1913 | Mahoney |
| 2,363,200 | A | | 11/1944 | Pew et al. |
| 2,813,402 | A | * | 11/1957 | Poethig et al. ..... 137/109 |
| 3,392,537 | A | | 7/1968 | Woerner |
| 4,683,921 | A | | 8/1987 | Neeser |
| 4,936,343 | A | | 6/1990 | Pruitt et al. |
| 5,113,905 | A | | 5/1992 | Pruitt et al. |
| 6,601,618 | B2 | * | 8/2003 | Tsukano et al. ..... 141/45 |

* cited by examiner

*Primary Examiner*—Ramesh Krishnamurthy
(74) *Attorney, Agent, or Firm*—Blynn L Shideler; Krisanne Shideler; BLK Law Group

(57) ABSTRACT

A valve, system and method for the delivery of gases or liquids is shown where the delivery persons can fill the system without having to enter the building and the system can continue to deliver gas to the user. There is no interruption of service while the system is being filled.

17 Claims, 21 Drawing Sheets

PRESSURE DIVERTER VALVE AND SYSTEM

This application claims the benefit of 60/413,173 filed Sep. 24, 2002.

FIELD

The present version of this invention relates generally to the field of valves and systems used to mix and control various gases for beverage, welding, medical and other fields.

BACKGROUND

This invention relates to devices used in the carbonated beverage industry and other industries using carbon dioxide, such as fire protection systems, welding, medical and other industries using compressed gases. This technology may have applications in additional other industries, for reasons of simplicity, this discussion will relate primarily to the beverage industry. It is in no way meant to limit the application of this invention to only the beverage industry.

The beverage industry uses carbon dioxide to carbonate and to move beverages from a storage tank to a dispensing area. For beverages such as beer, the beer can be contained in large kegs in the basement or storage room and the taps at the bar can dispense the beer. This method eliminates the storage of beer kegs in the bar area and allows the beer keg delivery and removal to occur in an area other than that in which patrons may be sitting. This type of system has existed for many years. In order to get the beverages from the storage area to the serving area, prior art has used carbon dioxide among other gases. The carbon dioxide is generally delivered as a liquid in large heavy DOT cylinders and hooked to the dispensing system. When the tanks are hooked to the system, a certain volume, generally about one third of the tank, in a one tank system or one third of the tank volume in a multi-tank system is not filled with liquid. This allows the carbon dioxide to boil to a gaseous state. It is this gaseous state that is then used to carbonate and to move the desired beverage from the storage room or basement to the delivery area and provide much of the carbonation to the beverages.

The only problem with this system is that the carbon dioxide tanks must be changed or when the current tanks run out, they must be replaced with new tanks. This can be inconvenient and time consuming. If only one person is working, then they are required to leave the patron area and manually change the tank to allow the refreshments to continue to flow. In addition, delivery of additional filled tanks cannot always occur when they are needed if a user runs out in the late evening or during non-business hours. This problem can be somewhat lessened by using multiple liquid tanks, but this uses more space and can be more expensive to monitor and refill.

To refill or replace a tank, the system must generally be completely shut down, so no beverages can be served, and service or delivery personnel can move the full liquid carbon dioxide tanks into the business and remove the empty tanks. Generally several valves must be shut off while the tanks are changed. The business must wait until the changeover is complete before beverages can be served again.

Some systems exist where the physical changing of the tanks has been eliminated. This is done by delivering liquid carbon dioxide to the tanks or system pre-existing in the businesses. Generally a pump truck delivers the liquid carbon dioxide to a fill line plumbed to the outside of the building. The delivery personnel must then enter the establishment to close and adjust various valves. The system is then shut down and the dispensing of beverages must cease until the filling process is complete. Delivery personnel must then return to the truck and start the pump. They must then carefully watch the system to attempt to determine when the system is full. This can be difficult to determine with any uniformity. Some weeks a business may do very well with beverages and some weeks may not do so well. While an operator may get a general sense, it is difficult to determine without the trial and error method, when the system is full.

Some art uses relief valves to indicate when the system is full. This method of determining when the system is full is wasteful and can result in increased pressure hazards from over filling. Over filling can also result in the system not operating properly.

The system needs to maintain the proper liquid gas ratios and overfilling lessens the efficiency of the system as a whole. When the delivery person determines that the system is full, he/she must then reverse the actions taken on the valves and disconnect the truck from the system. While these types of systems do eliminate much of the inconvenience of physically changing out tanks, there are still significant disadvantages to this liquid delivery system common in the art.

Some prior art uses o-rings in the valving and extensive connections and valves. These types of o-ring systems are notorious for failures. Once a system fails, the business may have no carbon dioxide for serving beverages. A call for maintenance may go unanswered if not during regular business hours. Thus, the beverage system may not be operational. The other failure mode of the o-rings or extensive connections or valving is to develop a leak. This causes gaseous carbon dioxide to leak in the storage area and depending on the size of the leak can be costly and hazardous.

For the foregoing reasons, there is a need for a liquid delivery system that would not require the delivery personnel to enter the business to shut/adjust valving before and after delivery of the liquid. There is also a need for a system that would allow the delivery at any time of day or night without any contact with the personnel inside the business. A system that aided in delivering the proper amount of liquid while also lessening the hazards associated with over filling is needed. Also needed is a system that would allow the business to continue using the beverage delivery system without interruption even when the system is being filled. This will result in more sales and less inconvenience to the business. A system that doesn't vent the liquid carbon dioxide to the atmosphere as a means of determining a filled system will also result in less waste, less cost to both the beverage and the delivery businesses and less potential hazards. A system that does not use o-rings and simplifies the number of connections and valving is also very desirable.

SUMMARY

In view of the foregoing disadvantages inherent in the tank removal/installation systems and the liquid pumping systems there is a need for a new approach for the liquid carbon dioxide and other pressurized gas delivery business.

A first object of this embodiment of the invention is to provide a system that can be filled without adjusting any interior valving or without entering the business to whom the liquid or gas is being delivered.

Another object of this embodiment of the invention is to provide a system that lessens the inconvenience and possible dangers of overfilling.

It is yet another object of this embodiment of the invention to provide a system that allows the use of the pressurized filling system while the system is being re-filled.

It is a still further object of this embodiment of the invention to provide a system that does not need to waste product to tell when the system is full.

It is another object of this embodiment of the invention that simplifies the number of connections and valves necessary which lessens the likelihood of leaking and waste.

For a better understanding of this invention, its operating advantages and the specific objects attained by its uses, reference should be had to the accompanying drawings and descriptive matter in which there is illustrated a preferred embodiment of this version of the invention.

BRIEF DESCRIPTION OF DRAWINGS

FIG. 17.5 shows a top side view of one embodiment of the valve assembly.

DETAILED DESCRIPTION OF THE PREFERRED EMBODIMENTS

Figure 1:
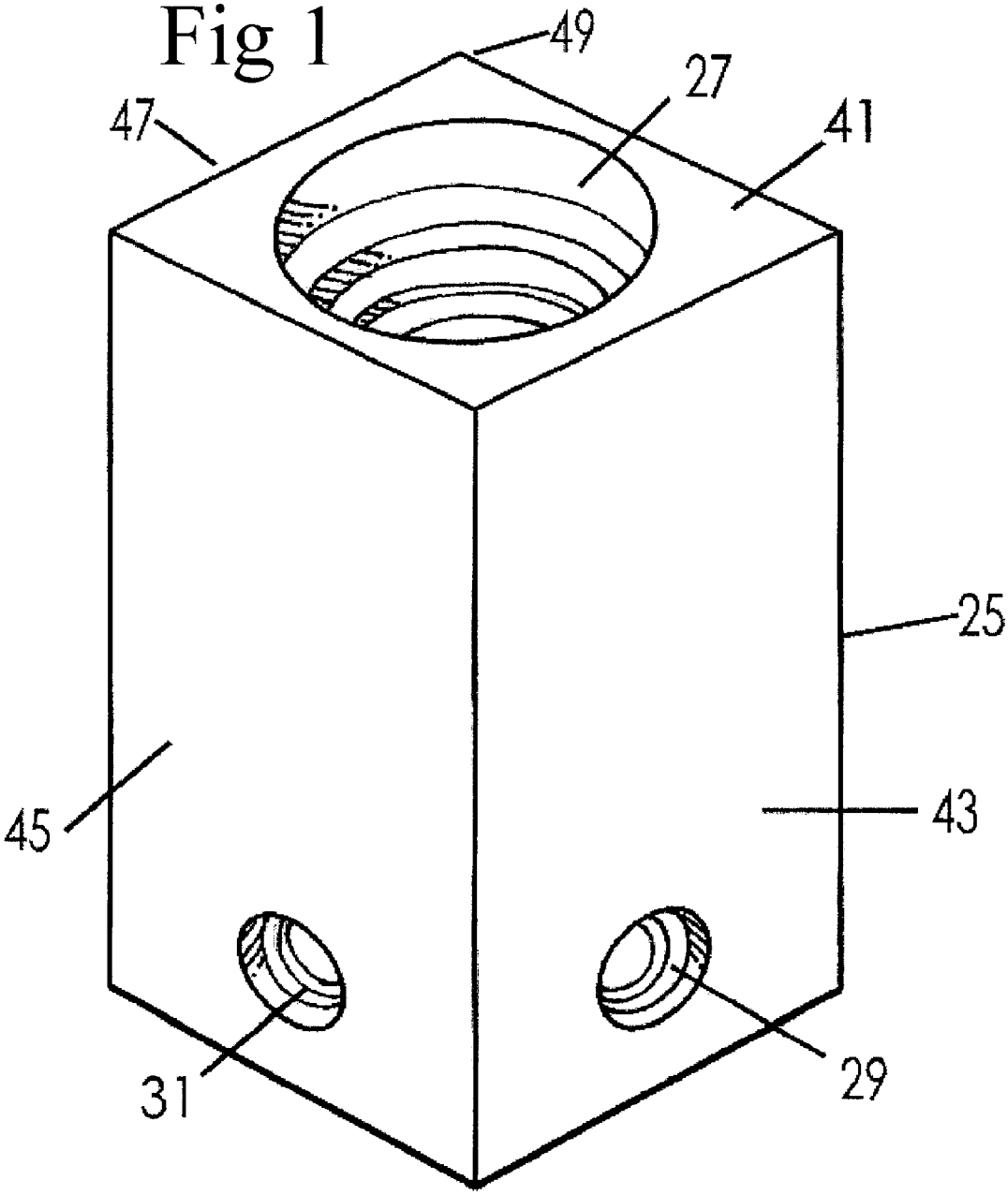
FIG. 1 shows a perspective view of one embodiment of the valve body.
Figure 2:
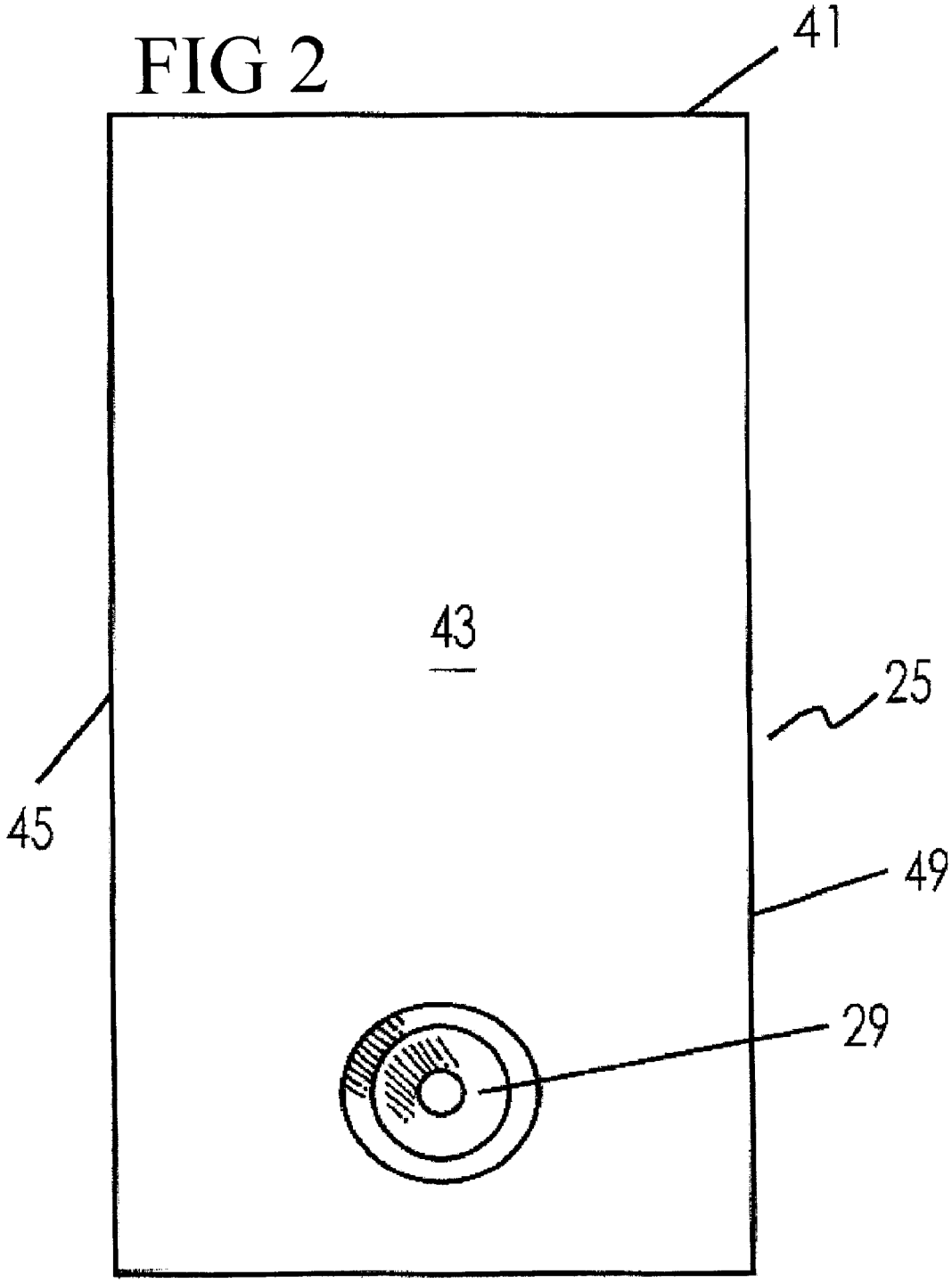
FIG. 2 shows a left side view of one embodiment of the valve body.
Figure 3:
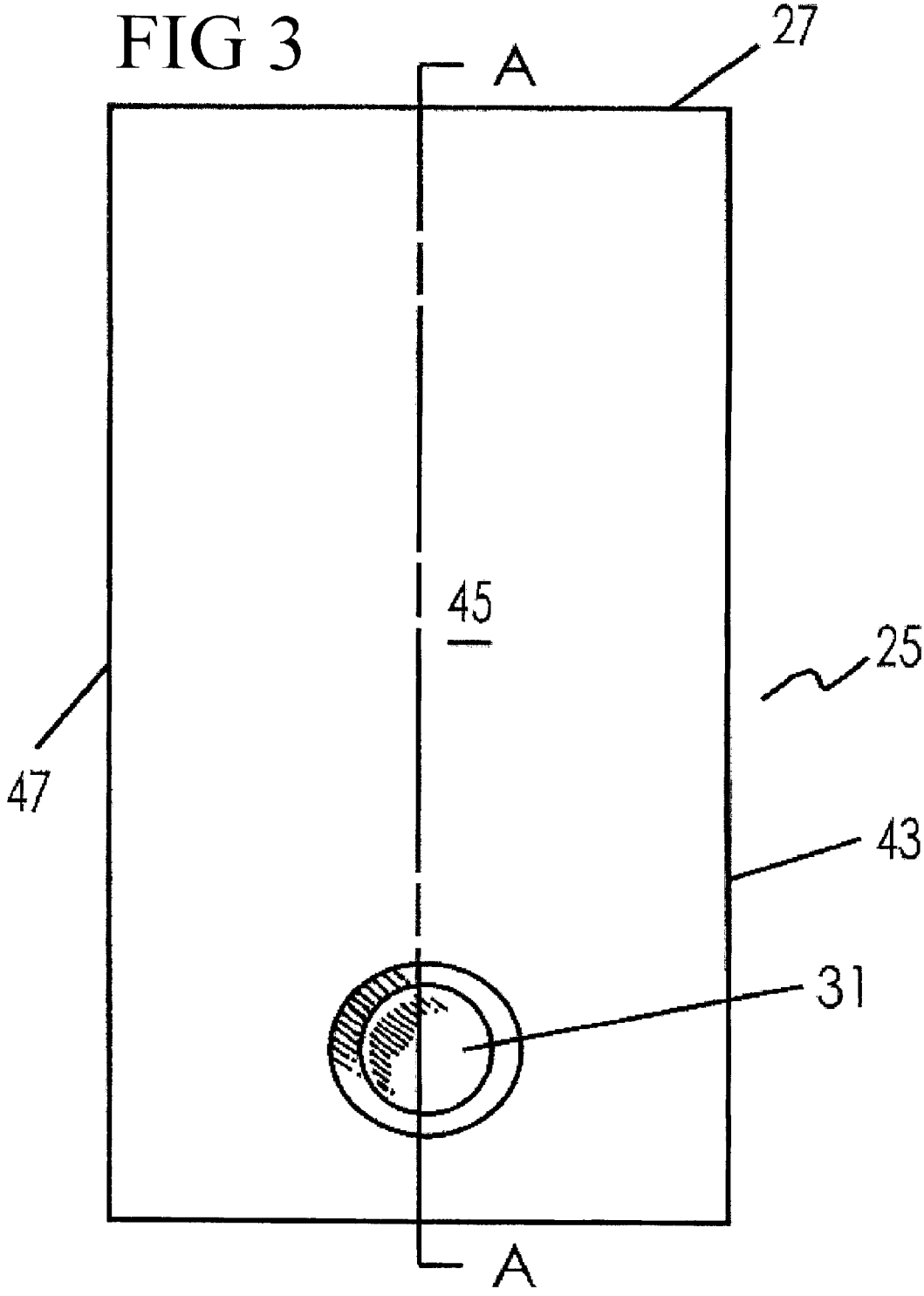
FIG. 3 shows a top side view of one embodiment of the valve body.
Figure 4:
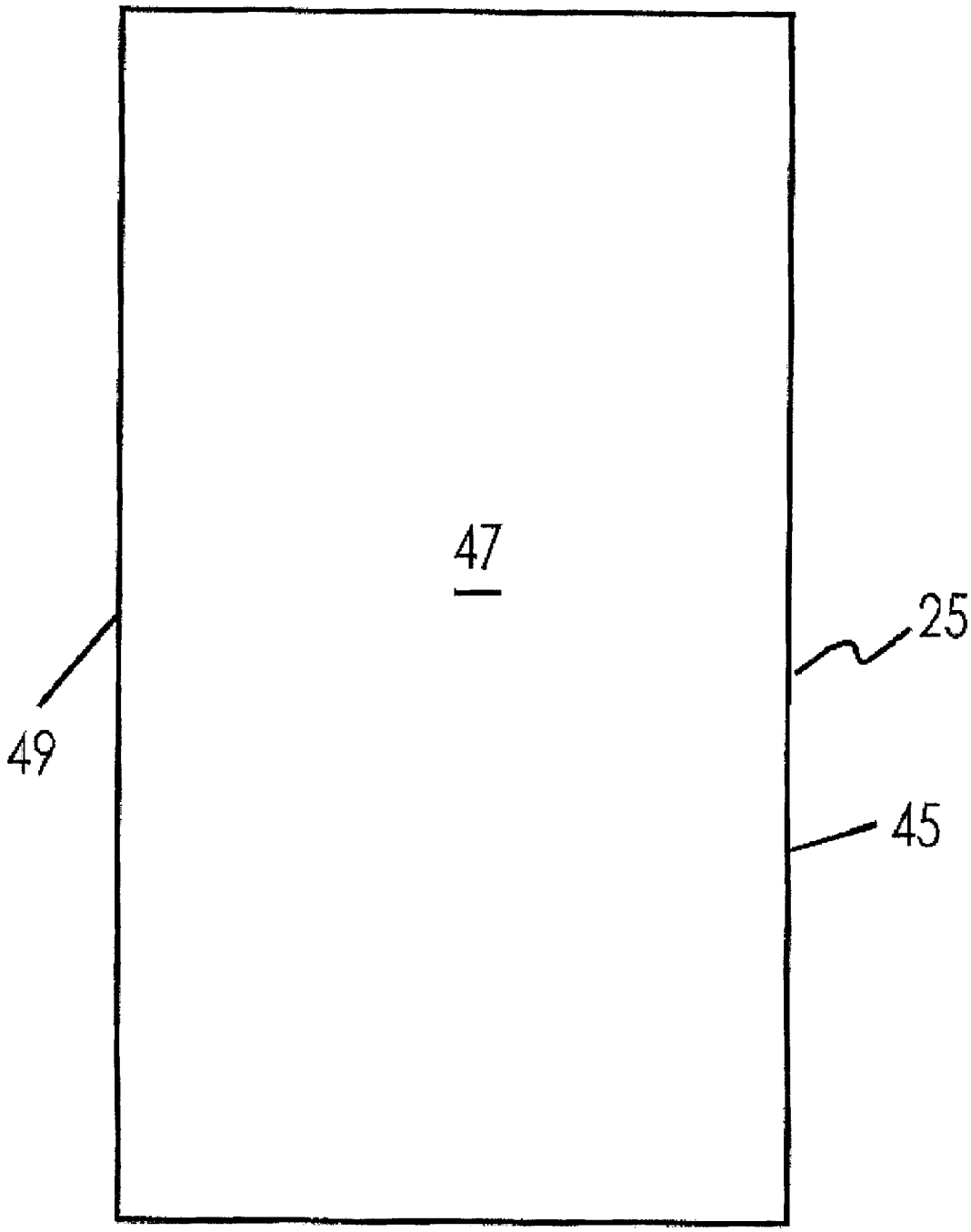
FIG. 4 shows a right side view of one embodiment of the valve body.

Referring to the drawings in detail wherein like elements are indicated by like numerals, there is shown in FIG. 1 a perspective view of one embodiment of the valve body 25. The valve body 25 has an inlet end 41, a right side 47, a left side 43, bottom side 49 and a top side 45 shown in this view. The shape of the valve body 25 is primarily rectangular, but other shapes would also work and the specific shape shown is not meant to be a limitation. In the inlet end 41 is shown an inlet port 27.

The valve body 25 is machined from 360 brass and the holes in one embodiment are tapped for ¼ NPT thread. It should be recognized that other grades of brass and other ferrous and non-ferrous materials could be used to manufacture the valve body 25. Other hole sizes are also anticipated as long as the hole size does not impede the function of the valve body 25.

Figure 9:
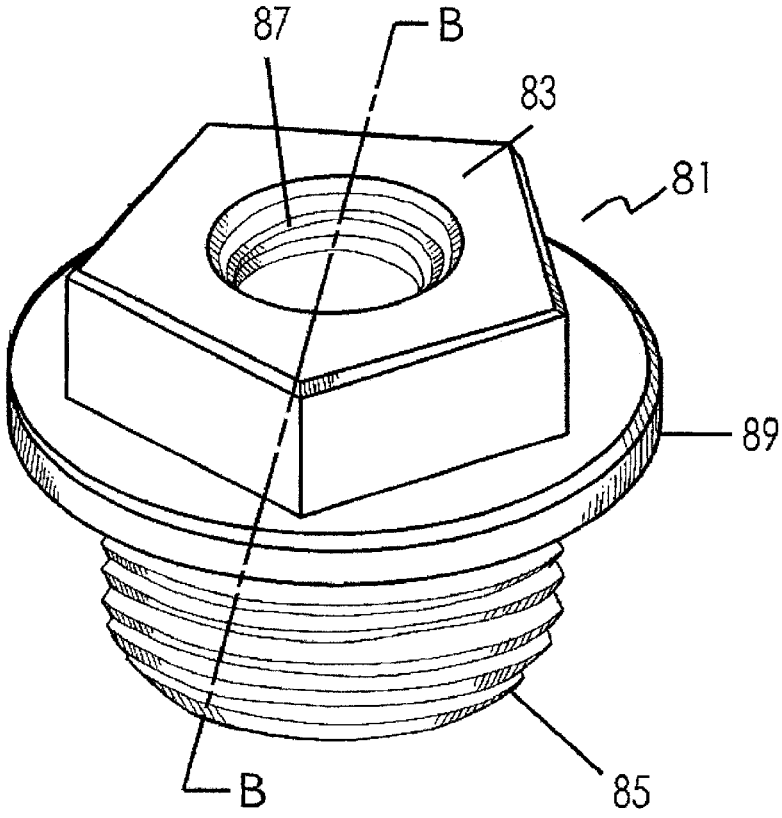
FIG. 9 shows a perspective view of one embodiment of the inlet fitting.
Figure 19:
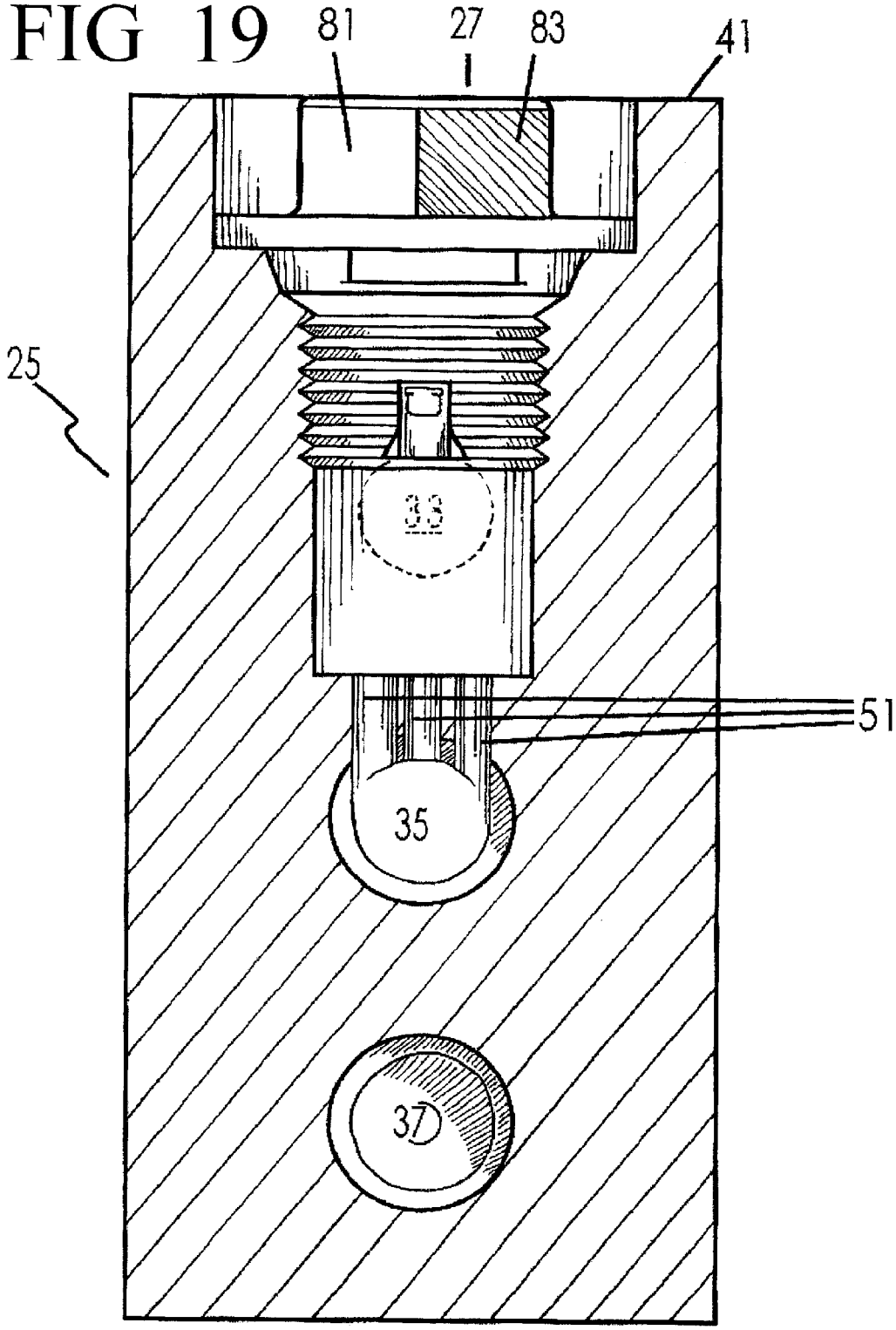
FIG. 19 shows a cross section view along line D—D in FIG. 17 of one embodiment of the valve assembly.

The inlet port 27 is threaded and this is where the liquid carbon dioxide is delivered through an inlet fitting 81, FIG. 9, to the valve body 25. The inlet fitting 81 is screwed into the inlet end 41 of the valve body 25. In one embodiment the head 83 of the inlet fitting 81 is housed within the inlet port 27 of the valve body 25, best shown in FIG. 19. The head 83 can be housed within the valve body 25 to discourage tampering by non-authorized personnel.

The left side 43 has a relief port 29 into which can be attached a relief valve (not shown) in the event that the system surpasses some predetermined pressure, the relief valve would relieve the pressure in the system. The top side 45 contains a user port 31. The user port 31 is where the user connects the beverage dispensing system to allow gaseous carbon dioxide to carbonate and deliver the beverages.

Figure 5:
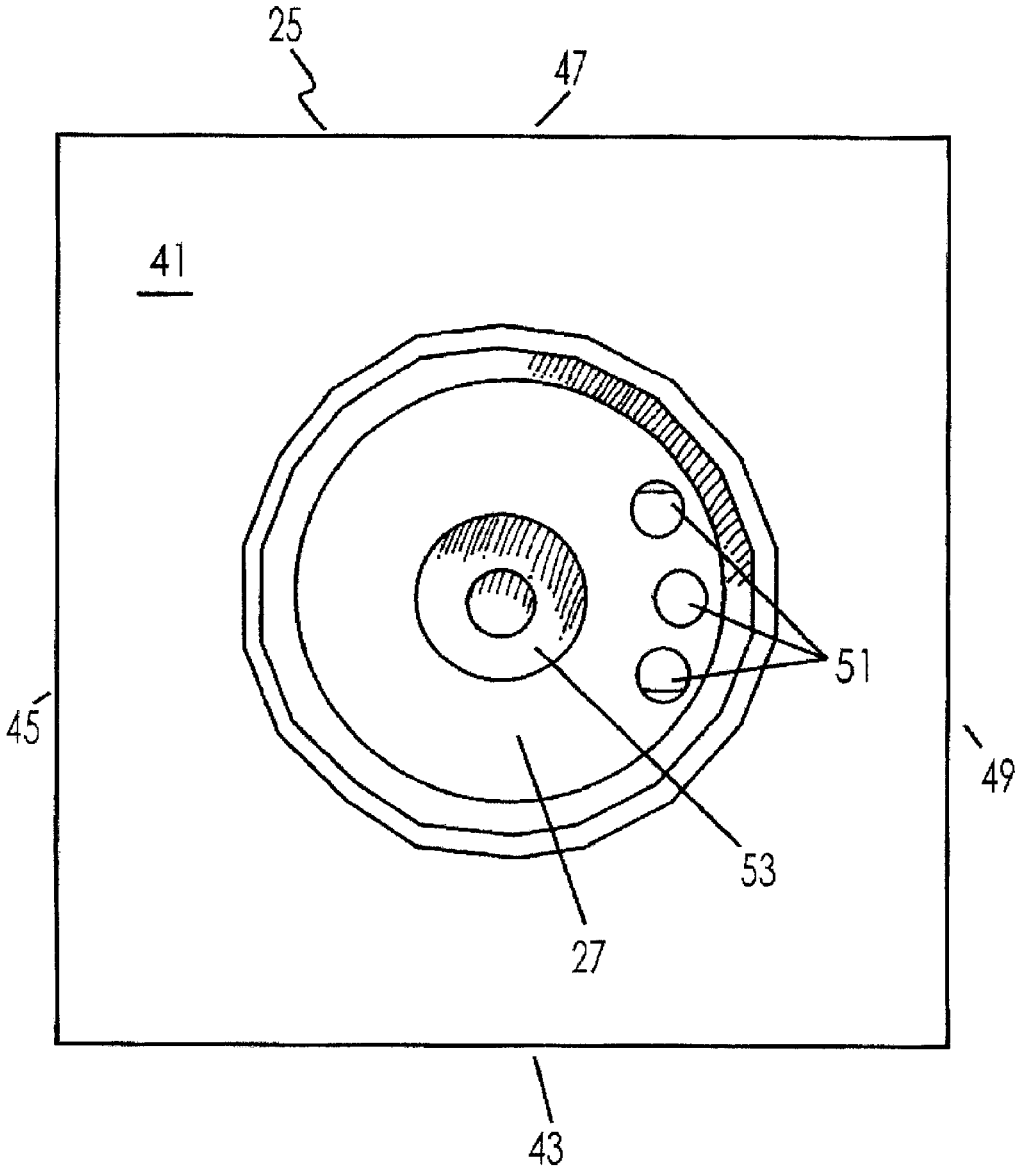
FIG. 5 shows an inlet end view of one embodiment of the valve body.

FIG. 5 shows a view of the inlet end 41 and inlet port 27 of valve body 25. Also seen in this view are three fill channels 51 and plunger cavity 53. While this particular embodiment shows three fill channels 51, more or fewer fill channels 51 could be used.

FIG. 1 also shows a burst disk 39 that could be housed in the top side 45 which interconnects with the plunger cavity 53, FIG. 5. The burst disk 39 would be an additional pressure relief device for the liquid side of the valve body 25.

Figure 6:
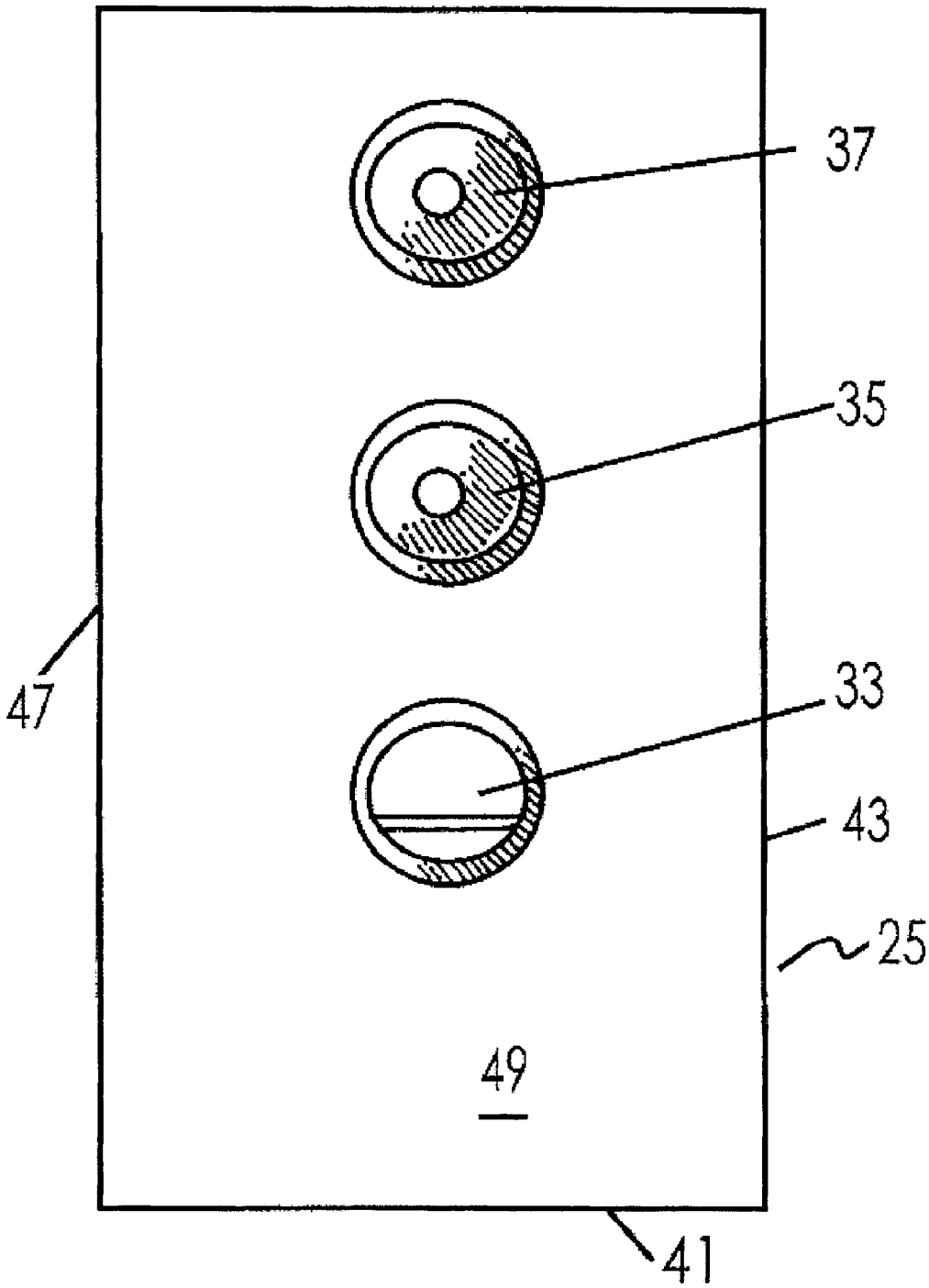
FIG. 6 shows a bottom side view of one embodiment of the valve body.
Figure 7:
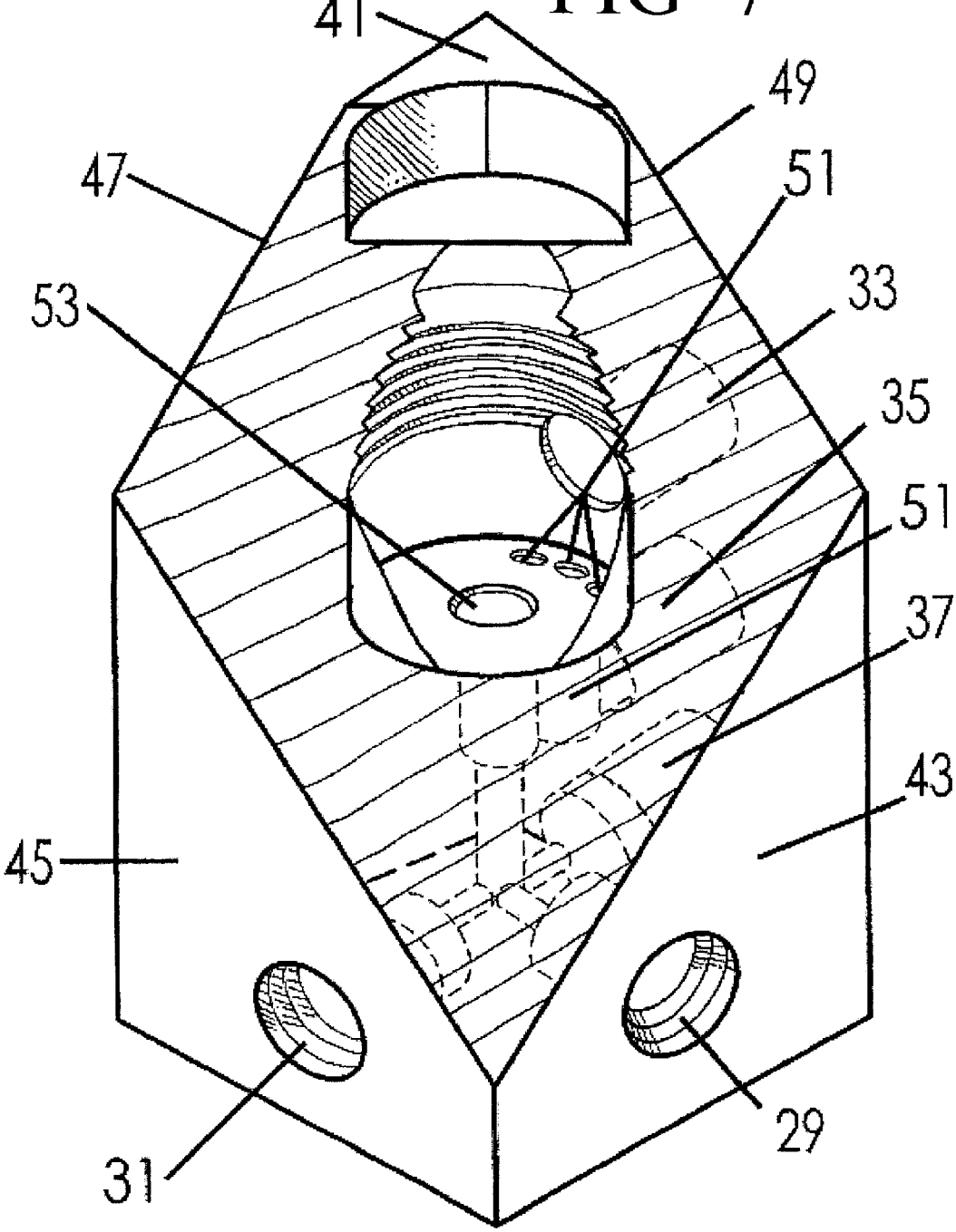
FIG. 7 shows a partial cutaway perspective view of one embodiment of the valve body.
Figure 8:
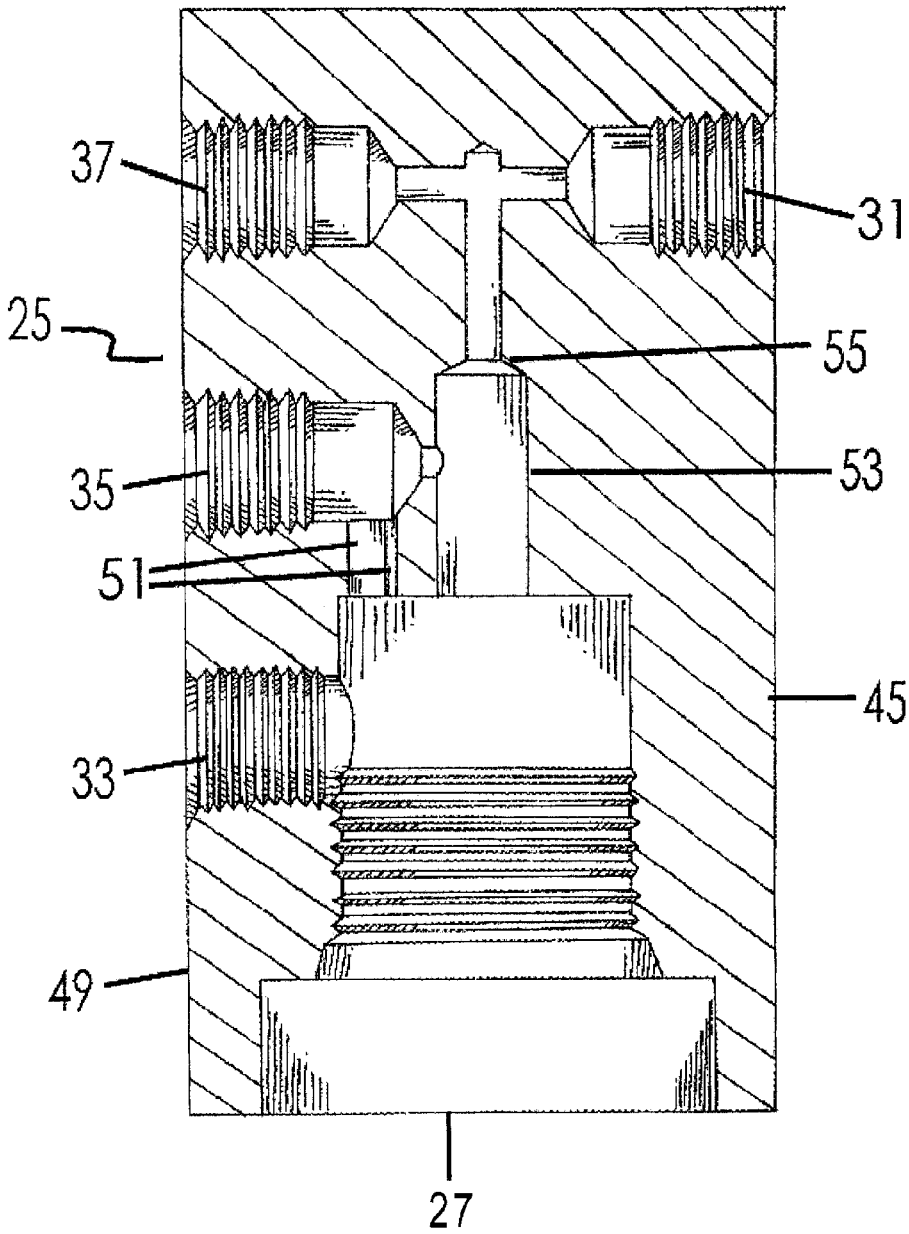
FIG. 8 shows a cross section view along line A—A in FIG. 3 of one embodiment of the valve body.

FIG. 6 shows the bottom side 49 of the valve body 25. This view details the gas storage port 37, second liquid port 35 and first liquid port 33. FIGS. 7 & 8 show how the gas storage port 37 and the first liquid port 33 and second liquid port 35 are interconnected. FIGS. 7 & 8 also show how the second liquid port 35 connects via the fill channels 51 to the plunger cavity 53. The plunger cavity 53 is also connected to the user port 31, second liquid port 35, the gas storage port 37 and relief port 29, best seen in FIGS. 7 & 8.

Figure 10:
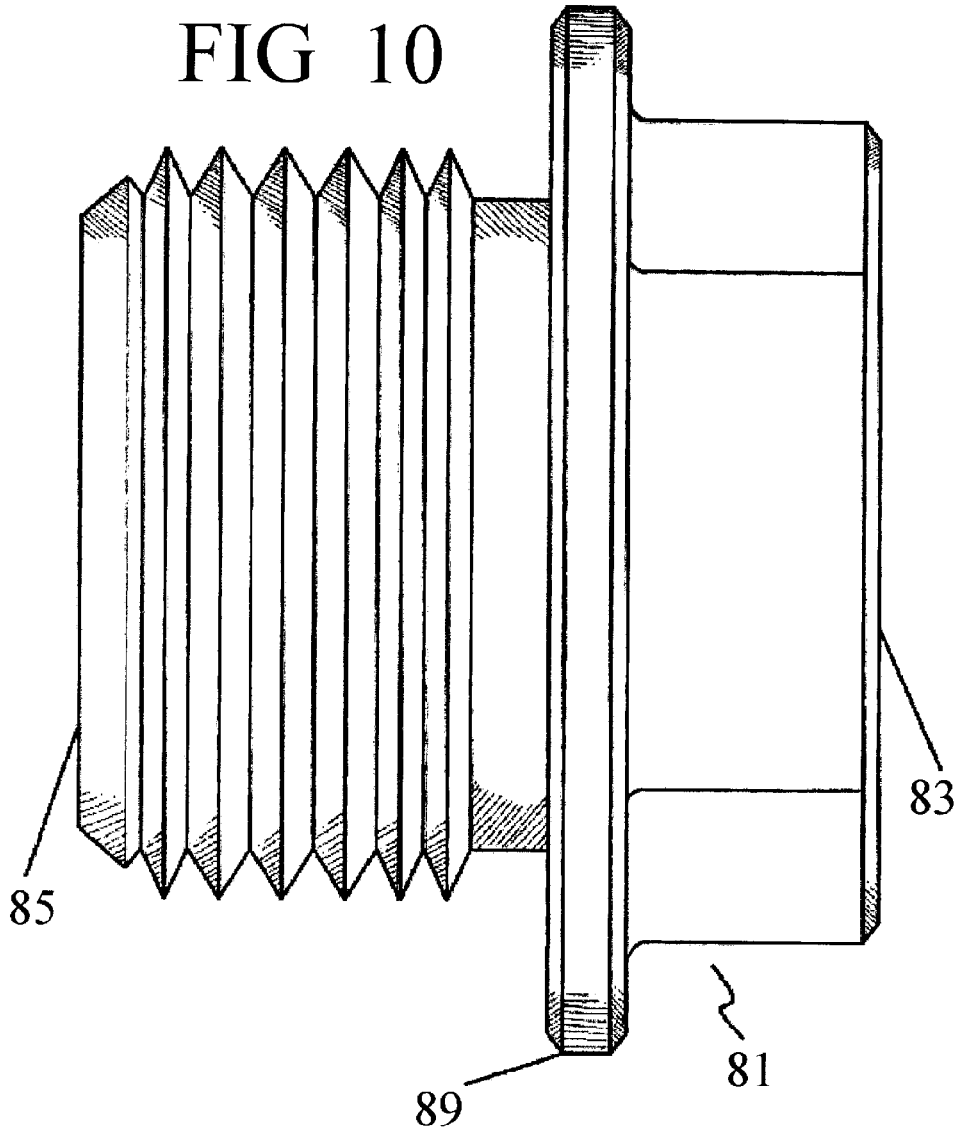
FIG. 10 shows a side view of one embodiment of the inlet fitting.

FIG. 9 shows a perspective view of the inlet fitting 81. The inlet fitting 81 is threaded to match the threads in the inlet port 27 of the valve body 25. The inlet fitting 81 is machined from 360 brass, however, it should be recognized that other grades of brass and other ferrous and non-ferrous materials could be used to manufacture the inlet fitting 81. The valve body 25 inlet port 27 also has a recess 28, FIG. 8, which when the inlet fitting 81 is installed, contains the head 83 of the inlet fitting 81 such that the head 83 sits flush or within the planar surface of the inlet end 41. The inlet hole 87 has standard pipe thread for receiving the piping or hose (not shown) through which the liquid carbon dioxide is to be delivered through the inlet hole 87. The inlet hole 87 runs through the inlet fitting 81 from the head 83 to the tail 85. FIG. 10 shows a side view of the inlet fitting 81 where there is a lip 89. This lip 89 seals against the floor of the recess 2B such that liquid or gaseous carbon dioxide does not leak from this intersection.

Figure 11:
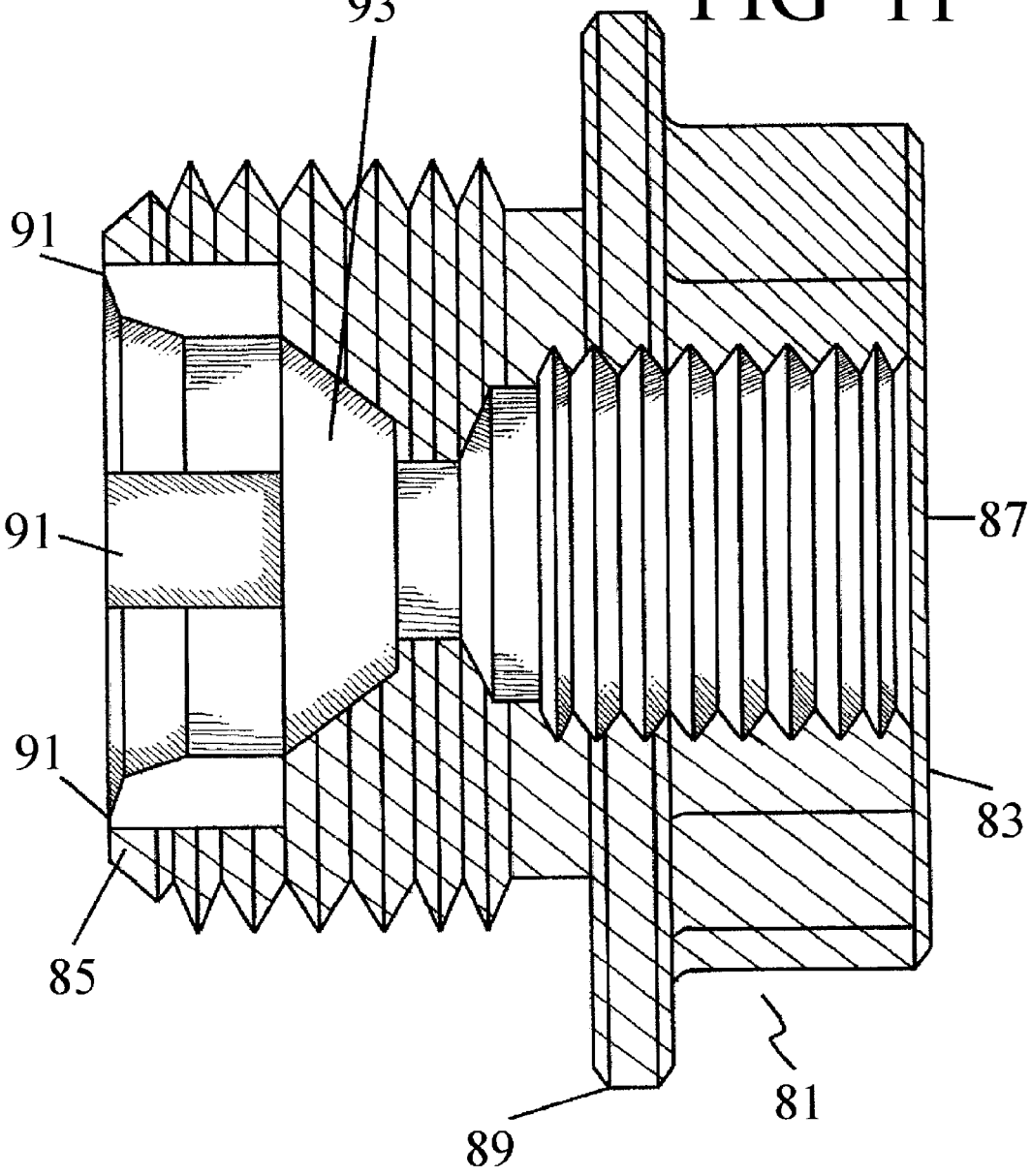
FIG. 11 shows a cross section view along line B—B in FIG. 9 of one embodiment of the inlet fitting.
Figure 12:
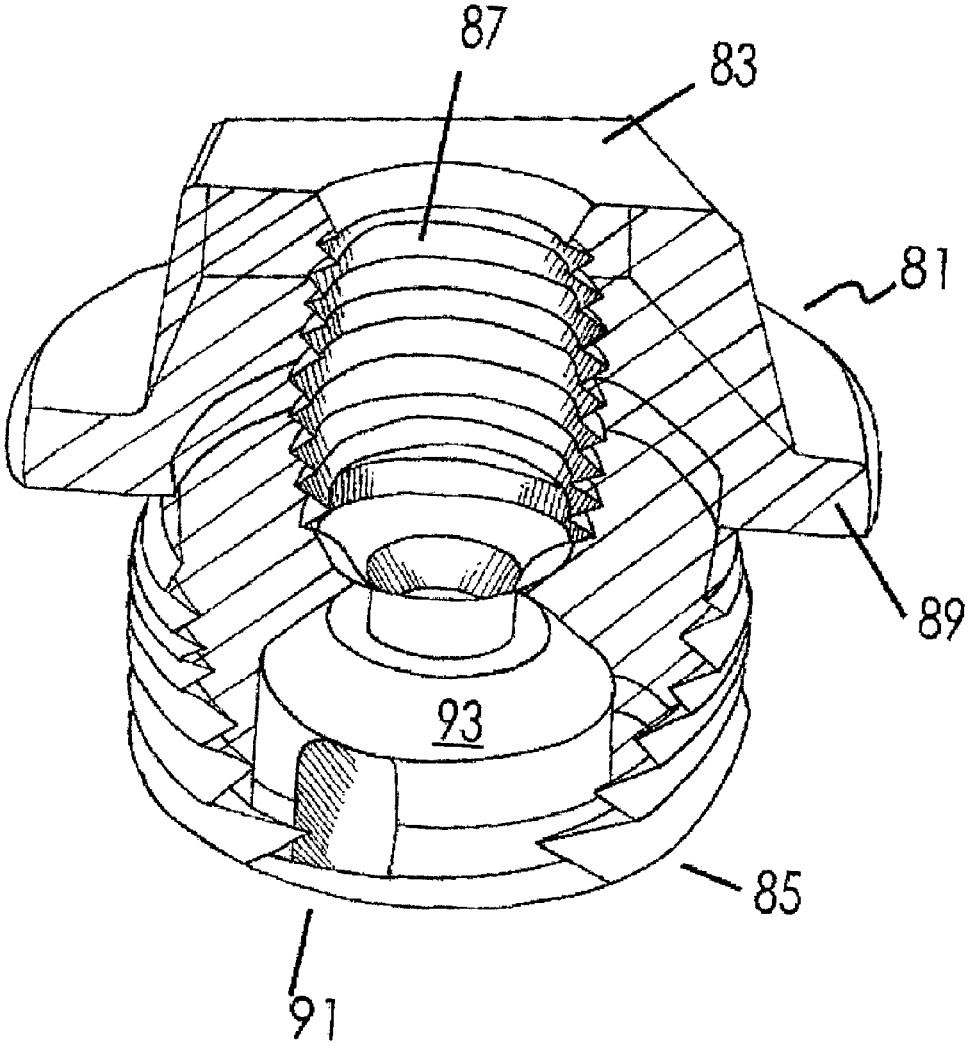
FIG. 12 shows a partial cutaway perspective view of one embodiment of the inlet fitting.
Figure 13:
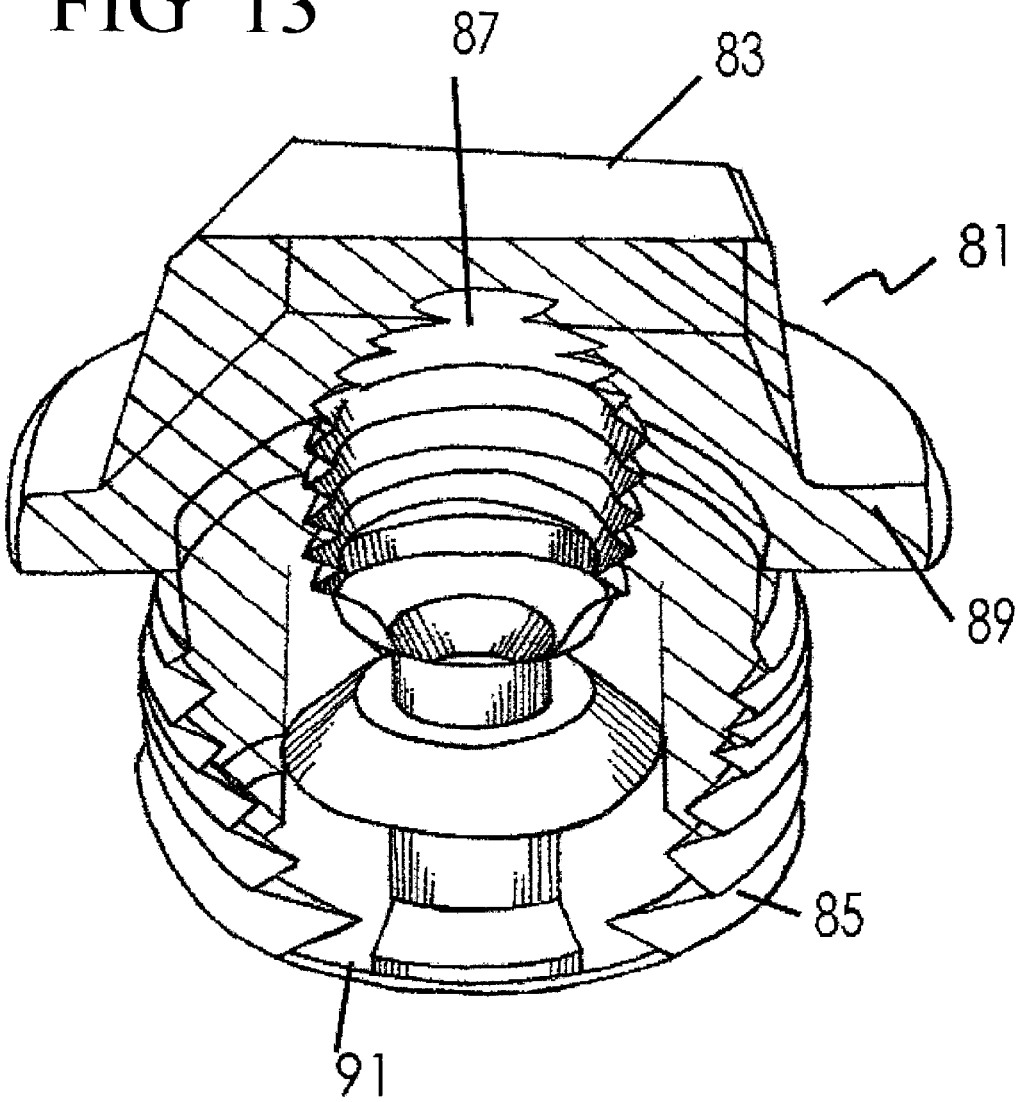
FIG. 13 shows a second cutaway perspective view of one embodiment of the inlet fitting.

FIG. 11 is a cross section view along line B—B in FIG. 9 of one embodiment of the inlet fitting 81, also FIG. 12. It can be seen that there are a series of slots 91 circumferentially around the inlet hole 87 in the tail end 85 of the inlet fitting 81. While this embodiment shows four slots 91 spaced about 90 degrees apart, it should be understood that more or fewer slots 91 could be placed here and the angles between these slots could be more or less than about 90 degrees. The inlet hole 87 of the inlet fitting 81 runs from the head 83 through to the tail 85 providing a hole all the way through the inlet fitting 81 such that the liquid carbon dioxide may pass through.

There is a chamfer 93 in the inlet fitting 81 circumferentially around inlet hole 87, nearer the tail 85, best seen FIG. 11. This chamfer is recessed from the tail end 85 a predetermined distance and is cut at a predetermined angle.

Figure 14:
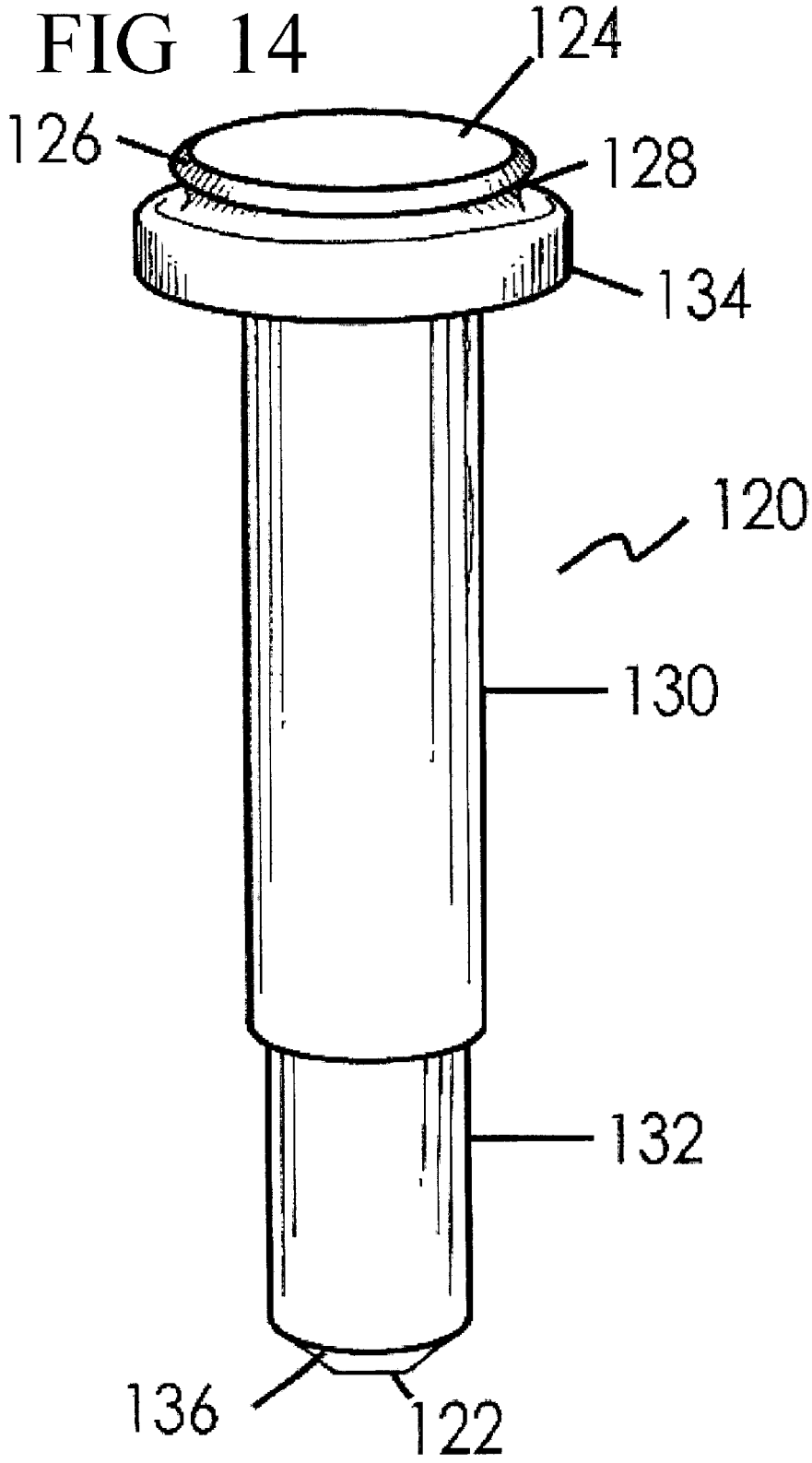
FIG. 14 shows a perspective view of one embodiment of the valve stem.
Figure 15:
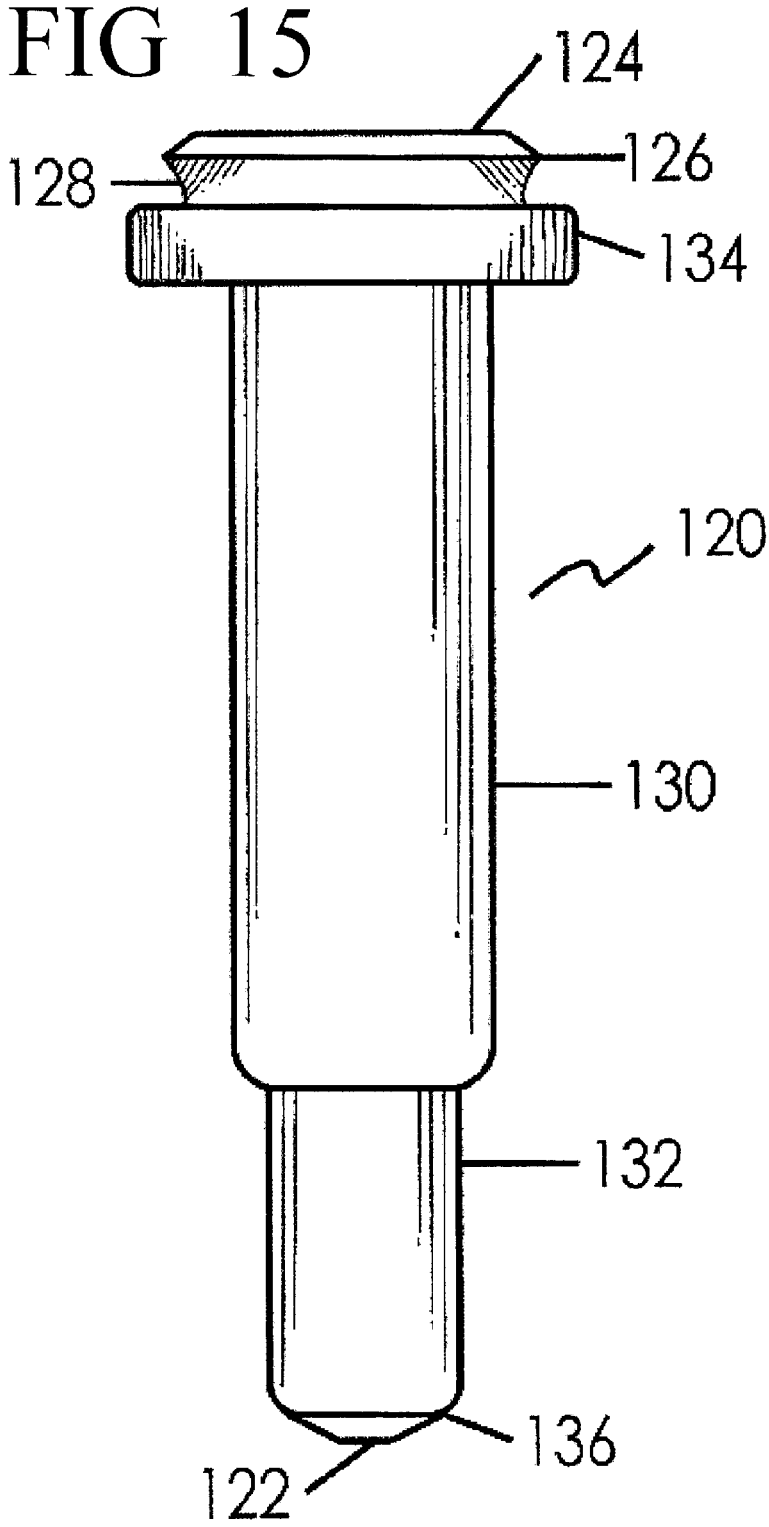
FIG. 15 shows a side view of one embodiment of the valve stem.

FIG. 14 shows a perspective view of one embodiment of the valve stem 120. The valve stem 120 is machined from 303 stainless steel. However it should be recognized that other grades of stainless steel and other ferrous and non-ferrous materials could be used to manufacture the valve stem 120. The valve stem 120 has a first end 122 and a second end 124. Near the second end 124 is shown a lip 126 near a smaller diameter groove 128. Near the groove 128 is an annular ledge 134. The valve stem 120 then narrows in cross sectional area in the stem 130 portion. The cross sectional area decreases again in the button 132 portion which terminates in the first end 122. The first end 122 terminates with a first end chamfer 136. FIG. 15 is a more detailed side view of one embodiment of the valve stem 120 which more clearly shows the lip 126, groove 128 and annular ledge 134. Also shown is the first end chamfer 136 near the first end 122.

Figure 16:
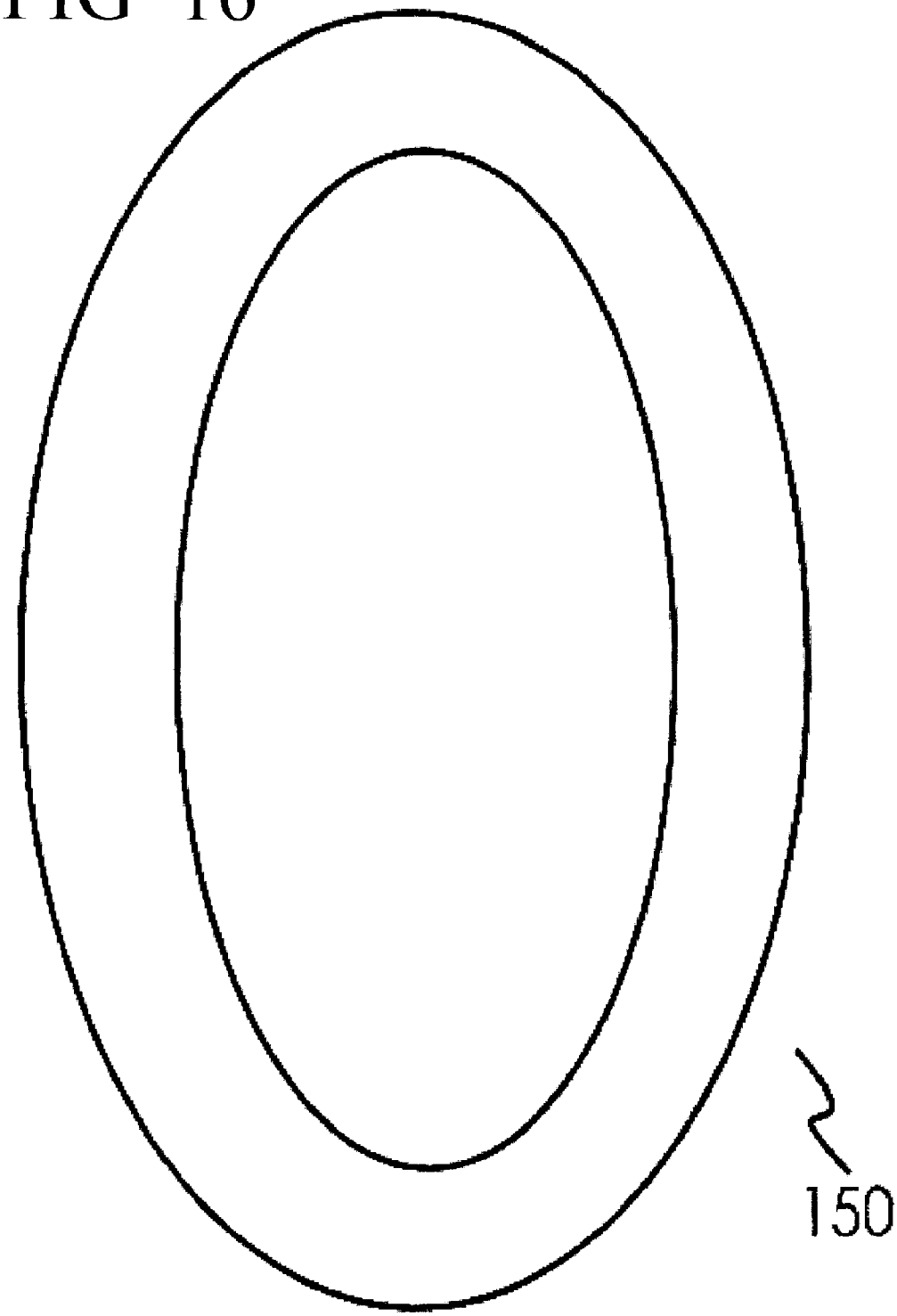
FIG. 16 shows a perspective view of one embodiment of the circumferential ring.

FIG. 16 is a perspective view of one embodiment of the circumferential ring 150. The circumferential ring 150 in one embodiment is made from a material like Teflon. Other polymers, ferrous and non-ferrous materials could be used for the circumferential ring 150.

Figure 17A:
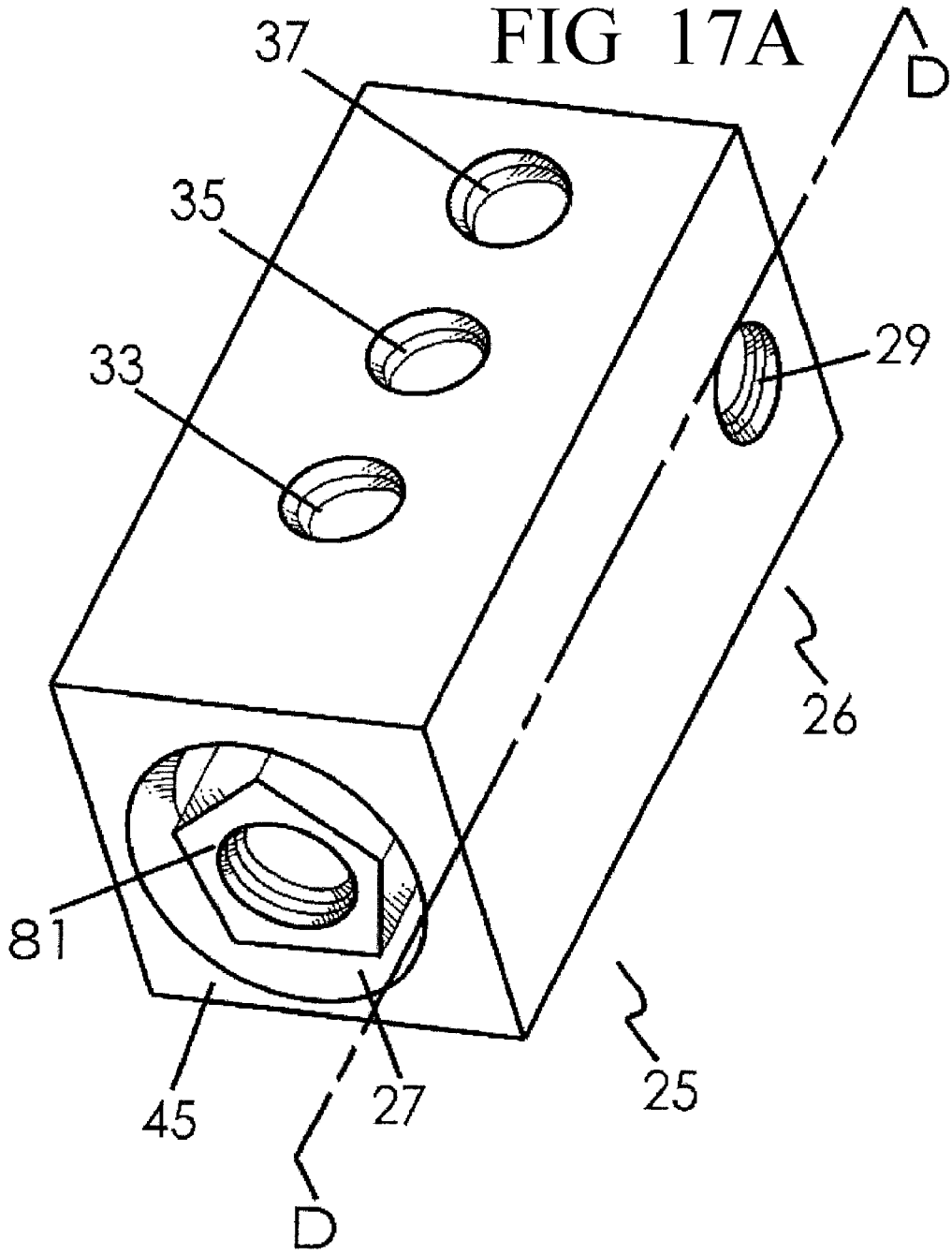
FIG. 17 shows a perspective view of one embodiment of the valve assembly.
Figure 17B:
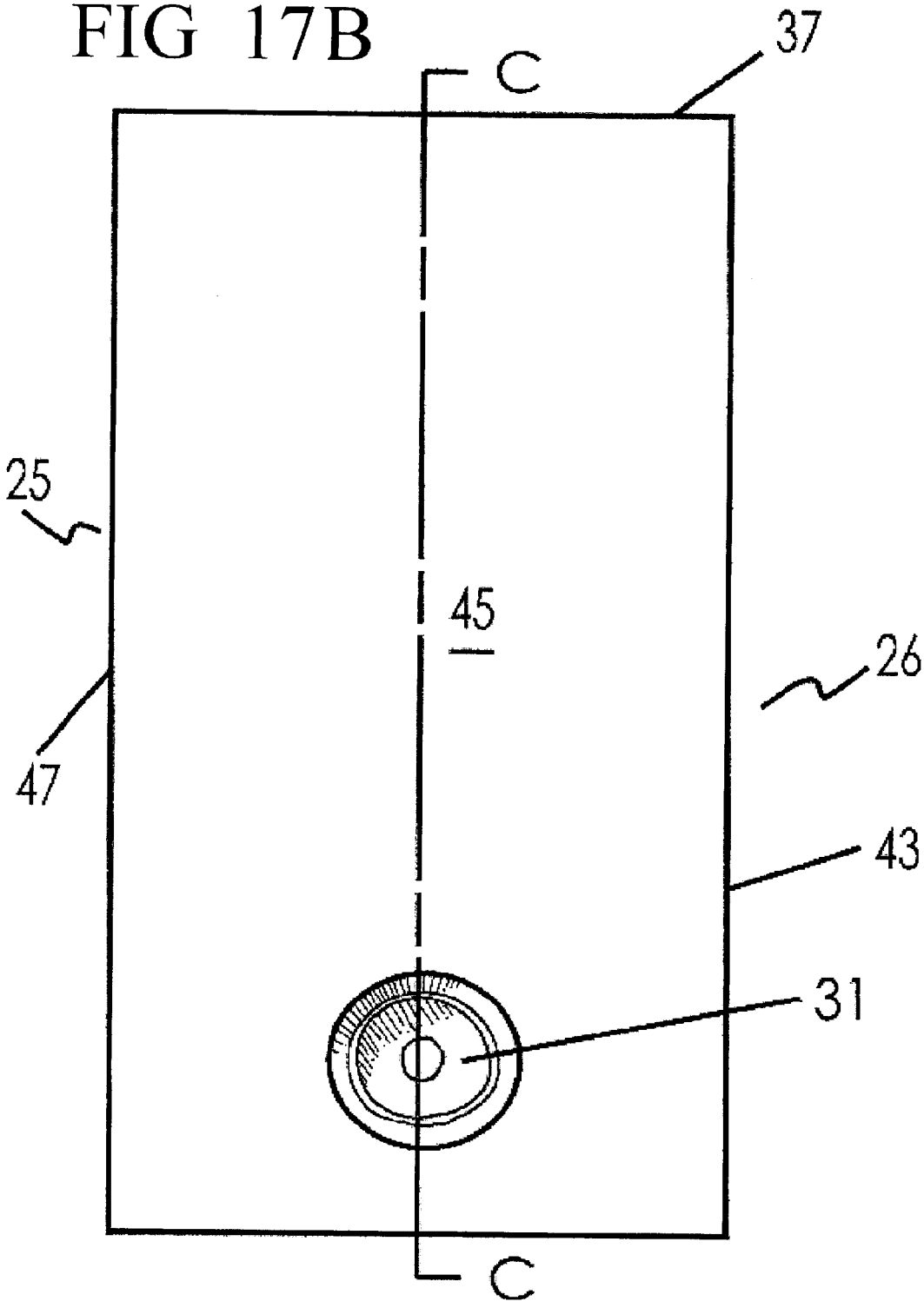
Figure 18:
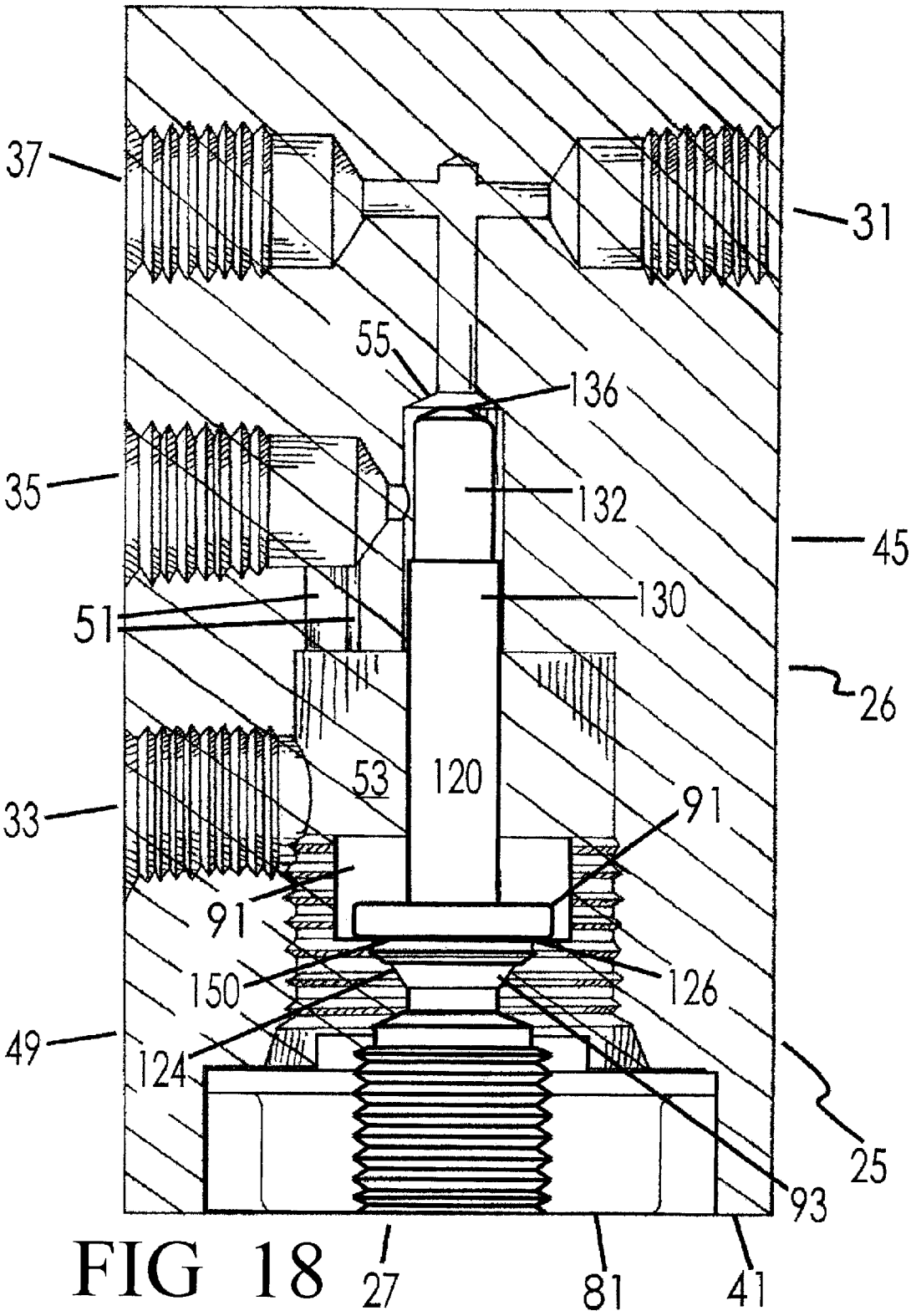
FIG. 18 shows a cross section view along line C—C in FIG. 17.5 of one embodiment of the valve assembly.

FIG. 17 shows a perspective view of one embodiment of the valve assembly 26. The valve assembly consists of the valve body 25, the inlet fitting 81, and the valve stem 120 with circumferential ring 150 attached. FIG. 18 shows a cross section view along line C—C in FIG. 17.5 of one embodiment of the valve assembly 26.

Filling Operation

Figure 20:
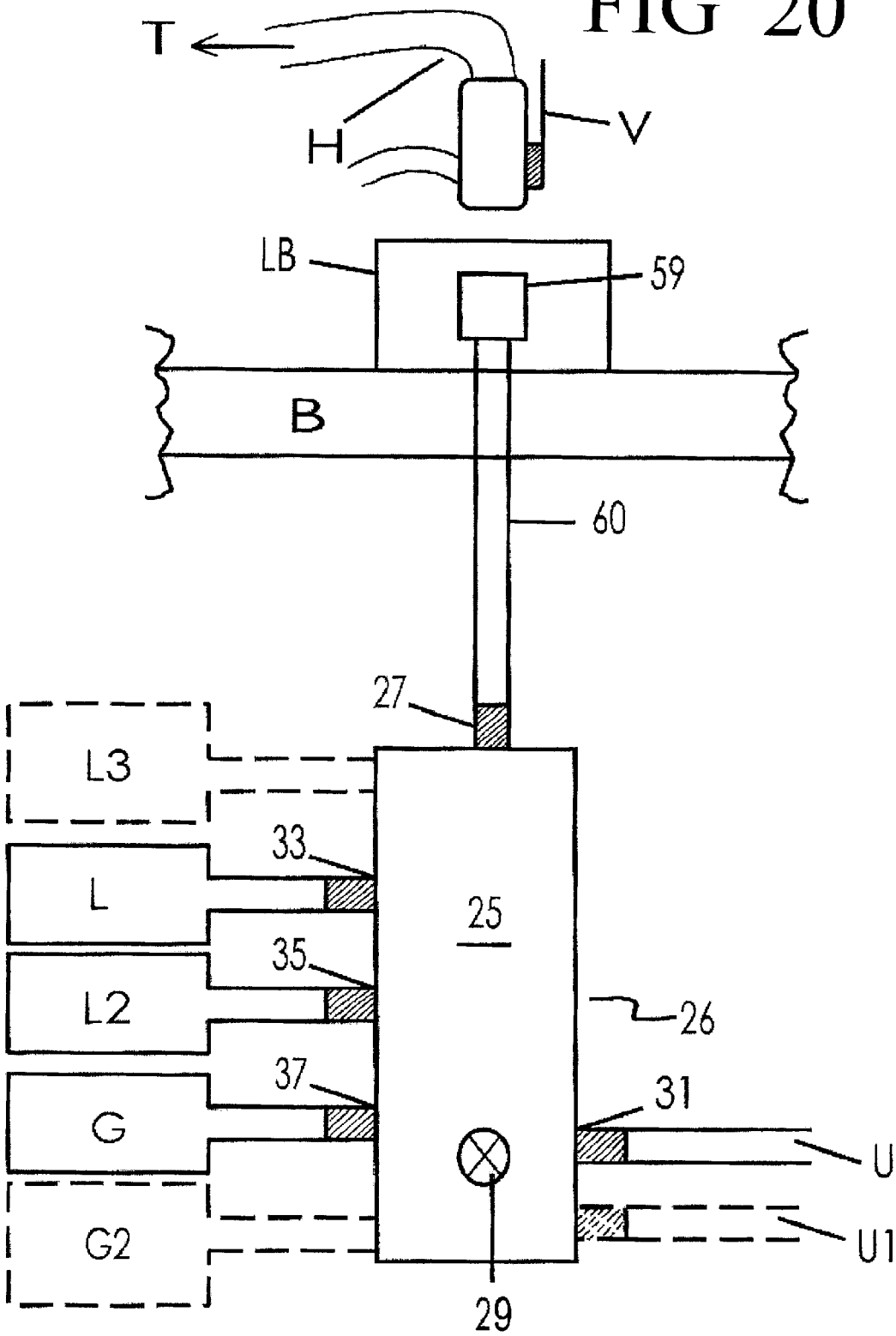
FIG. 20 shows an overview or schematic of the valve assembly and related components.

FIG. 20 shows an overview or block diagram of the complete system, not to scale. Filling the liquid tanks L, L2 requires that the hose H on the truck T be connected to the to the coupler 59 and the valve V on hose H be opened. Coupler 59 can be located outside of the building B, thus, the operator does not need to enter the building B to deliver the liquid and product can be delivered when the business or user is not open with no interaction from the user. The coupler 59 could also be located in a locked box LB with a door (not shown), to prevent tampering or vandals. It should be noted that no damage could occur to either the system inside the building or harm to a vandal because this embodiment maintains zero pressure on all fittings in the box LB and at the coupler 59 prior to connection to the truck T hose H.

Once the liquid begins to flow through the inlet line 60 the change in pressure in the inlet line 60 causes the valve stem 120, FIG. 14, to translate towards the gas storage port 37, best shown in FIG. 18.

When the valve stem 120 reaches the plunger stop 55, best shown in FIG. 18, the first end chamfer 136 engages with the plunger stop 55 and seals the gas storage port 37 and the user port 31 from the rest of the valve assembly 26. As the valve stem 120 seals these elements from the rest of the system, the liquid carbon dioxide continues to flow through the inlet port 27 around the second end 124 of the valve stem 120. The liquid continues through the slots 91 into the plunger cavity 53 and out the first liquid port 33 into the liquid tank L, FIG. 20.

The liquid carbon dioxide also flows from the plunger cavity 53 through the fill channels 51 out the second liquid port 35 to the liquid tank L2. When the liquid tanks L and L2 are full the truck T pump senses an increase in pressure and the pump shuts down. If for some reason, the pump did not shut off, then burst disk 39, shown FIG. 1, if installed, would relieve the pressure from the valve assembly 26. The operator (not shown) then closes valve V, disconnects the hose H from the coupler 59 on the exterior of the building and continues to the next delivery stop.

When the hose H is disconnected, the sudden change in pressure causes the valve stem 120 to translate toward the inlet fitting 81, best shown in FIG. 18. The lip 126 and circumferential ring 150 engage the chamfer 93 of the inlet fitting 81 sealing the system off from the coupler 59, FIG. 20. The liquid is then free to boil off or change to gas, and flow from the tanks L & L2 into plunger cavity 53 and through gas storage port 37 for storage in tank G, or flow through the user port 31 to be utilized by the user U.

It should be noted that when the valve stem 120 engages the plunger stop 55 while the liquid tanks L and L2 are filling, the system is still operational and gas is still capable of flowing to the user U. The Gas can flow from the gas storage tank G through the gas storage port 37 ou the user port 31. The dispensing system does not need to be shut down to be filled, and transparently remains operational to the user.

While this embodiment shows two liquid tanks L & L2 it should be understood that many more liquid tanks or only one tank could be utilized in other embodiments, FIG. 20. Likewise, only one gas tank G is shown. It should be understood that many more gas tanks could be utilized in other embodiments, FIG. 20. Likewise, only one user port 31 is shown, there could be many users branching off from the user port 31 in other embodiments, FIG. 20. While many liquid tanks and gas tanks could be attached to the system it is helpful to maintain the gas storage tank to the liquid storage tank numbers in an approximate ratio of one to three.

FIG. 20 shows an overview of the valve assembly and related components in the system. The valve assembly 26 has the flexibility to be mounted almost anywhere inside the building B. The valve assembly 26 could be located on the interior wall of building B or mounted to the liquid or gas tanks. The valve assembly 26 could also be locked in a box (not shown) in the interior of building B to prevent tampering or vandals. Likewise, the valve assembly 26 could be located on the exterior of the building B if the user so chose.

It will now be apparent to those skilled in the art that other embodiments, improvements, details and uses can be made consistent with the letter and spirit of the foregoing disclosure and within the scope of this patent application.

I claim:

1. A valve assembly for receiving and directing the flow of pressurized liquid product to the liquid storage tank and gaseous product to the gaseous storage tank and to the user port for use by a user, the valve assembly comprising:

a valve body having an inlet port interconnected with at least one each of a liquid port, a gas storage port and a user port, the valve body having a plunger cavity with a plunger stop at one end;

a valve stem having a first end with a first end chamfer and a second end with a groove located between a lip and an annular ledge;

a circumferential ring located on the valve stem in the groove;

an inlet fitting having an inlet hole there through, the inlet fitting for engaging the in let port of the valve body, allowing the flow of pressurized liquid product and retaining the valve stem within the plunger cavity between a chamfer in the inlet fitting and plunger stop of the valve body; and whereby, the flow of pressurized liquid into the inlet hole causes the valve stem and first end chamfer to translate toward and engage the plunger stop in the plunger cavity closing the interconnection of the gas storage port and user port with the liquid port and the inlet port thereby filling and pressurizing the liquid storage tank where upon the reaching of a predetermined pressure, the incoming pressurized liquid ceases to flow, the incoming pressure goes to zero and the valve stem translates toward the inlet fitting where the lip and circumferential ring engage the chamfer of the inlet fitting sealing off the pressurized valve assembly from the atmosphere.

2. The valve assembly of claim 1 further comprising:

at least one slot in the inlet hole of the inlet fitting near a tail.

3. The valve assembly of claim 1 further comprising:

a burst disk mounted in the valve body interconnecting the plunger cavity and the atmosphere.

4. The valve assembly of claim 1 wherein:

the inlet port is configured such that when the inlet fitting is installed in the valve body, the head of the inlet fitting rests below the plane of the inlet end of the valve body to prevent tampering and removal of the inlet fitting by unauthorized persons.

5. The valve assembly of claim 1 further comprising:

at least one fill channel connecting the plunger cavity and a second liquid port.

6. A valve assembly for receiving and directing pressurized liquid to a liquid storage tank and directing gaseous product to a gas storage tank and to a user, the valve assembly comprising:

a valve body having an inlet port, at least one liquid storage port, at least one gas storage port and at least one user port, a plunger cavity interconnected with the ports having a plunger stop near one end of the plunger cavity;

a valve stem having a first end chamfer near a first end and a groove located between a lip and annular ledge on the second end;

a circumferential ring located in the groove of the valve stem;

an inlet fitting having an inlet hole there through from a head to a tail, a chamfer and at least one slot located near the tail, the inlet fitting engaging the inlet port and retaining the valve stem between the inlet fitting and the plunger stop of the plunger cavity; and whereby pressurized liquid flowing into the inlet hole of the inlet fitting causes the plunger to translate such that the first end chamfer engages the plunger stop closing off the user port and gas port from the other ports, the liquid flows through the slots and liquid storage port to the liquid storage tank, when a pre-determined pressure is reached, the flow of liquid into the inlet fitting ceases the pressure goes to zero, the pressure in the system causes the valve stem to translate toward the inlet fitting and the lip and circumferential ring seal against the chamfer of the inlet fitting sealing the inlet port and valve assembly from the atmosphere.

7. The valve assembly of claim 6 further comprising:

at least one fill channel connecting the plunger cavity and a second liquid port.

8. The valve assembly of claim 6 further comprising:

a burst disk mounted in the valve body interconnecting the plunger cavity and the atmosphere.

9. The valve assembly of claim 6 wherein:

the inlet port is configured such that when the inlet fitting is installed in the valve body, the head of the inlet fitting rests below the plane of the inlet end of the valve body to prevent tampering and removal of the inlet fitting by unauthorized persons.

10. A valve assembly for filling liquid carbon dioxide tanks and providing gaseous carbon dioxide, the valve assembly comprising:

a valve body having at least one inlet port, at least one liquid port, at least one gas storage port and at least one user port, interconnecting passages connecting the ports and a plunger cavity, a plunger stop located within the plunger cavity;

a valve stem having a lip and groove near the second end and a first end chamfer near a first end, the valve stem for selectively closing the inlet port and liquid port from the gas storage port and the user port;

an inlet fitting for engaging the valve body inlet port and valve stem, the inlet fitting having an inlet hole there through from a head to a tail, a circumferential chamfer in the inlet hole near the tail end;

a circumferential ring for engaging the groove of the valve stem; and whereby the application of liquid carbon dioxide to the inlet port causes the valve stem to translate and seal the first end chamfer against the plunger stop sealing the user port and gas storage port from the first liquid port and the inlet port, liquid carbon dioxide flows into the inlet port through the inlet fitting and out the first liquid port for storage, upon reaching a pre-set pressure, the flow of liquid carbon dioxide ceases, the pressure in the inlet port goes to zero and the valve stem translates toward the inlet fitting sealing the lip and circumferential ring against the chamfer of the inlet fitting sealing the valve body inlet port from the atmosphere.

11. The valve assembly of claim 10 further comprising:

a burst disk housed in the valve body and interconnecting the plunger cavity to the atmosphere.

12. The valve assembly of claim 10 further comprising:

at least one slot in the inlet hole of the inlet fitting near the tail.

13. The valve assembly of claim 10 wherein:

the inlet port is configured such that when the inlet fitting is installed in the valve body, the head of the inlet fitting rests below the plane of the inlet end of the valve body to prevent tampering and removal of the inlet fitting by unauthorized persons.

14. A system for providing carbonation and beverage delivery of liquids to a user, the system comprising:

an inlet line connected to an inlet fitting having slots, the inlet fitting connected to a valve body, the valve body having a valve stem, a plunger cavity with a plunger stop and interconnecting passages, the interconnecting passages also connected to a first liquid port which is attached to a liquid storage tank, a gas storage port which is which is attached to a gas storage tank, a user port which is attached to the beverage delivery system, a circumferential ring attached to one end of the valve stem, whereby liquid carbon dioxide in the inlet line causes the valve stem to translate and seat in the plunger stop isolating the user port and gas storage port and gas storage tank from the remaining system, the liquid carbon dioxide flows around the valve stem through the slots, out the liquid port and fills the liquid storage tank, when the system reaches a pre-determined pressure, the liquid carbon dioxide ceases to flow the pressure goes to zero, the valve stem translates toward the inlet fitting sealing off the system from the atmosphere where the liquid carbon dioxide boils off and flows to the gas storage port and tank and through the user port for carbonation of the beverage and delivery of the beverage to the user.

15. A system for carbonating and delivering beverages to a user, the system comprising:

an inlet line for filling the system with liquid carbon dioxide attached to an inlet fitting which is housed in an inlet port of a valve body, the inlet fitting interconnected to a plunger cavity, liquid port, gas port and user port allowing the flow of liquid and gas, the plunger cavity having a plunger stop, a circumferential ring attached to a valve stem which is located in the plunger cavity of the valve body such that when liquid carbon dioxide fills the inlet line, the plunger translates to a plunger stop closing off the user port and gas port from the remainder of the system, the liquid carbon dioxide flows through the inlet fitting and through the liquid port and to a liquid storage receptacle, such that when the liquid storage receptacle fills and the system reaches a pre-determined pressure, the incoming liquid ceases to flow and the valve stem translates toward a chamfer in the inlet fitting such that the system is closed off from the atmosphere, the liquid carbon dioxide boils off and flows to the gas storage port and a gas storage receptacle and the user port for carbonation and selective delivery of the beverage to the user, where the user can selectively get carbonated beverage when the system is filling with liquid carbon dioxide.

16. A method for filling a system that provides for the carbonation and delivery of beverages, comprising the steps of:

attaching and pumping a supply of liquid carbon dioxide to an inlet line and valve assembly;

providing a means to direct the liquid carbon dioxide to a storage tank while automatically closing off a gas port and a user port;

pumping the liquid carbon dioxide until the storage tank, valve assembly and inlet line reach a pre-determined pressure;

shutting off and disconnecting the supply of liquid carbon dioxide; and automatically closing the valve assembly from the atmosphere such that the liquid is allowed to boil off and provide carbonation to a beverage and delivery to a user.

17. A method for filling a system that provides carbonation and delivery of beverages to a user, comprising the steps of:

attaching a hose and pumping liquid carbon dioxide through an inlet fitting housed in a valve assembly;

causing the translation of a valve stem to isolate a gas port and a tank and a user port and directing the liquid carbon dioxide to a liquid port and a tank; and stopping the pumping of the liquid carbon dioxide upon reaching a pre-determined pressure and removing the hose allowing the translation of the valve stem to close the valve assembly from the atmosphere and allowing the liquid to boil to a gas to provide delivery and carbonation to the beverage.

* * * * *